US009205320B2

(12) United States Patent
Mason

(10) Patent No.: US 9,205,320 B2
(45) Date of Patent: Dec. 8, 2015

(54) HEAD AND NECK PROTECTION SYSTEM

(71) Applicant: Roger J. Mason, Pickerington, OH (US)

(72) Inventor: Roger J. Mason, Pickerington, OH (US)

(73) Assignee: MASON ENTERPRISES ATHLETIC EQUIPMENT LLC, Pickerington, OH (US)

( * ) Notice: Subject to any disclaimer, the term of this patent is extended or adjusted under 35 U.S.C. 154(b) by 23 days.

(21) Appl. No.: 13/947,614

(22) Filed: Jul. 22, 2013

(65) Prior Publication Data

US 2014/0020161 A1 Jan. 23, 2014

Related U.S. Application Data

(60) Provisional application No. 61/741,513, filed on Jul. 23, 2012.

(51) Int. Cl.

| | |
|---|---|
| ***A63B 71/10*** | (2006.01) |
| ***A41D 13/015*** | (2006.01) |
| ***A42B 3/04*** | (2006.01) |
| ***A63B 71/12*** | (2006.01) |
| *A63B 71/06* | (2006.01) |

(52) U.S. Cl.

CPC ..... *A63B 71/10* (2013.01); *A41D 13/015* (2013.01); *A42B 3/0473* (2013.01); *A63B 71/12* (2013.01); *A63B 2071/0694* (2013.01); *A63B 2071/1208* (2013.01); *A63B 2209/10* (2013.01)

(58) Field of Classification Search

CPC ..... A41D 13/0512; A41D 13/015; A41D 13/0518; A42B 3/00; A42B 3/20; A42B 3/0473; A42B 3/04; A42B 3/046; A42B 3/12; A42B 3/18; A42B 1/08; A63B 71/10; A63B 71/12; A63B 71/1291

USPC ..... 2/461, 462, 468, 424, 425, 467, 410, 2/456

See application file for complete search history.

(56) References Cited

U.S. PATENT DOCUMENTS

| | | | | |
|---|---|---|---|---|
| 396,141 | A | | 1/1889 | Chappell et al. |
| 2,756,429 | A | | 7/1956 | Malachowski |
| 3,707,004 | A | | 12/1972 | Kapitan et al. |
| 3,855,631 | A | * | 12/1974 | Ettinger ..... 2/468 |
| 3,878,561 | A | | 4/1975 | Winiecki |
| 3,879,761 | A | | 4/1975 | Bothwell |
| 3,991,421 | A | | 11/1976 | Stratten |
| 4,999,855 | A | * | 3/1991 | Brown ..... 2/421 |
| 5,159,715 | A | * | 11/1992 | Jurga et al. ..... 2/462 |
| 5,295,271 | A | | 3/1994 | Butterfield et al. |
| 5,353,437 | A | | 10/1994 | Field et al. |
| 6,385,781 | B1 | | 5/2002 | Rose et al. |
| 6,397,402 | B1 | | 6/2002 | Holland et al. |
| 6,588,022 | B1 | | 7/2003 | Anders et al. |
| 6,968,576 | B2 | | 11/2005 | McNeil et al. |
| 7,120,941 | B2 | | 10/2006 | Glaser |
| 7,941,873 | B2 | | 5/2011 | Nagely et al. |
| 8,181,281 | B2 | | 5/2012 | Nagely et al. |

(Continued)

*Primary Examiner* — Andrew W Collins

(74) *Attorney, Agent, or Firm* — Kegler Brown Hill & Ritter; James J. Pingor

(57) ABSTRACT

A head and neck protection system is provided that includes a dome including a rear frame and a cage attached to a front of the rear frame and an upper torso padded portion removably attached to a bottom of the dome portion. The dome is configured such that a when a wearer's head moves in its full range of motion, the wearer's head does not touch the inside of the dome portion in any direction such that a force from a collision is transmitted to the wearer's upper torso, thereby bypassing the wearer's head and neck.

14 Claims, 6 Drawing Sheets

(56) References Cited

U.S. PATENT DOCUMENTS

| | | | | |
|---|---|---|---|---|
| 8,276,217 | B1 | 10/2012 | Hamilton | |
| D696,466 | S * | 12/2013 | Silva | D29/107 |
| 2011/0072567 | A1 | 3/2011 | Duhame | |
| 2012/0167289 | A1* | 7/2012 | Kim | 2/461 |
| 2012/0278980 | A1* | 11/2012 | Chuback | 2/461 |
| 2013/0031706 | A1* | 2/2013 | Cooksey | 2/459 |
| 2014/0237707 | A1* | 8/2014 | Lane | 2/414 |

* cited by examiner

HEAD AND NECK PROTECTION SYSTEM

CROSS-REFERENCE TO RELATED APPLICATIONS

This application claims the benefit of U.S. Provisional Patent application Ser. No. 61/741,513 entitled "BIG WINDOW/HIGH & TIGHT (HELMET & SHOULDER PADS SYSTEM) 2.0" filed on Jul. 23, 2012. The entirety of the above-noted application is herein incorporated by reference.

ORIGIN

The innovation disclosed herein relates to protective head gear and more specifically, to a head and neck protective system that transmits any forces or shocks created by a collision away from the head and neck.

BACKGROUND

Approximately 300,000 sports related concussions and 3.8 million traumatic brain injuries (TBI) occur annually in the United States. Trauma to the head and neck caused by forces from collisions can lead to a wide range of catastrophic and sometimes fatal injuries. Depending upon the strength, angle and duration of these forces, the impact can cause a wide array of serious head and spine injury along the entire length of the spine, resulting, in some cases, in complete quadriplegia, and even in death.

These injuries in contact sports and other impact activities are attributed to the deficient design of the conventional helmet. For example, the conventional American football helmet has a polycarbonate shell with padding inside the shell and a face mask attached to the front of the helmet. A chin strap secures the helmet to the player's head. For additional protection, shoulder pads that function independently of the helmet are worn to protect the player's shoulders from a collision. During certain collisions between opposing players, however, the player's head stops abruptly while the shoulders and the rest of the body keep moving, thus causing the neck to buckle from excessive axial loading and compression.

Additional pads, such as cervical collars, neck rolls, etc. may be worn in an attempt to provide additional protection to the head and neck area. The additional padding, however, does not address the underlying problem of axial loading transmitted from the head to the cervical spine. In addition, the additional padding restricts the movement of the player's head thereby limiting the player's performance.

SUMMARY

The following presents a simplified summary in order to provide a basic understanding of some aspects of the innovation. This summary is not an extensive overview of the innovation. It is not intended to identify key/critical elements or to delineate the scope of the innovation. Its sole purpose is to present some concepts of the innovation in a simplified form as a prelude to the more detailed description that is presented later.

In an aspect of the innovation, a head and neck protection system is provided that includes a dome including a rear frame and a cage attached to a front of the rear frame and an upper torso padded portion removably attached to a bottom of the dome portion. The dome is configured such that a when a wearer's head moves in its full range of motion, the wearer's head does not touch the inside of the dome portion in any direction such that a force from a collision is transmitted to the wearer's upper torso, thereby bypassing the wearer's head and neck.

In another aspect of the innovation a helmet and shoulder/vest system is disclosed that includes a rear frame, a cage attached to a front of the rear frame and having a plurality of viewports defined between intersecting vertical members and cross members, wherein the rear frame and the cage form the helmet, a base ring formed around a bottom perimeter of the rear frame and cage, shoulder pads, a front protector attached to a front of the shoulder pads, and a rear protector attached to a rear of the shoulder pads, wherein the base ring engages a top of the shoulder pads, front protector, and rear protector such that a force from a collision is transmitted to the wearer's shoulders and upper torso, thereby bypassing the wearer's head and neck.

To accomplish the foregoing and related ends, certain illustrative aspects of the innovation are described herein in connection with the following description and the annexed drawings. These aspects are indicative, however, of but a few of the various ways in which the principles of the innovation can be employed and the subject innovation is intended to include all such aspects and their equivalents. Other advantages and novel features of the innovation will become apparent from the following detailed description of the innovation when considered in conjunction with the drawings.

BRIEF DESCRIPTION OF THE DRAWINGS

FIG. 4 A is a close-up view of a tightening device for the head and neck protection system in accordance with the innovation.

DETAILED DESCRIPTION

Figure 2:
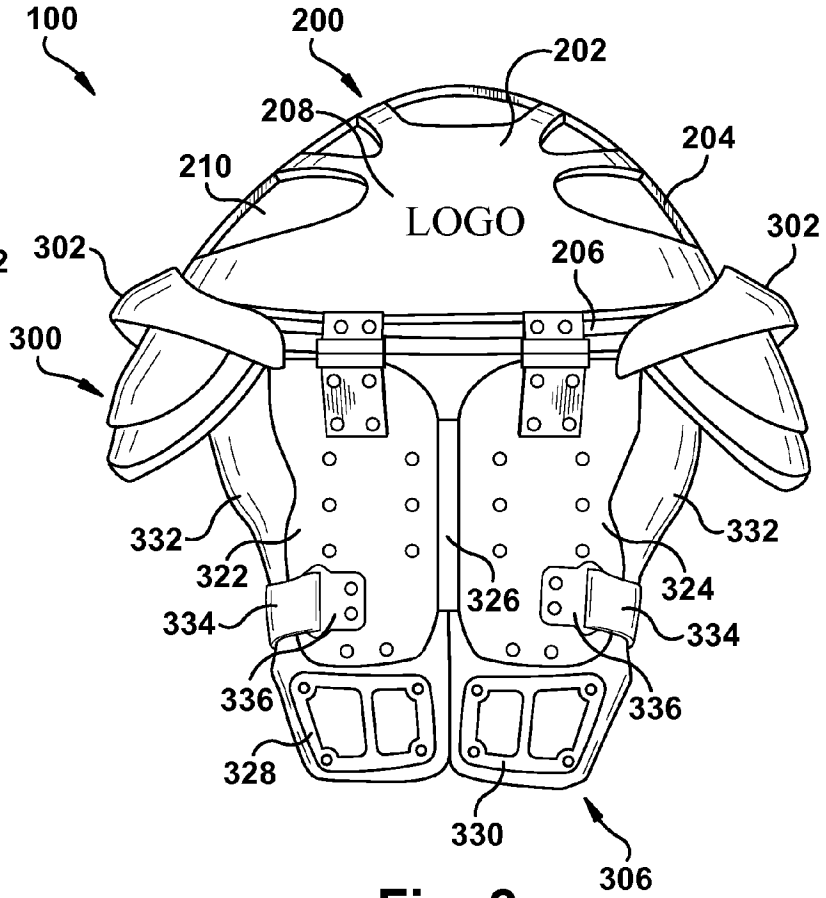
FIG. 2 is a rear view of the head and neck protection system in accordance with the innovation.

The innovation is now described with reference to the drawings, wherein like reference numerals are used to refer to like elements throughout. In the following description, for purposes of explanation, numerous specific details are set forth in order to provide a thorough understanding of the subject innovation. It may be evident, however, that the innovation can be practiced without these specific details. In other instances, well-known structures and devices are shown in block diagram form in order to facilitate describing the innovation.

While specific characteristics are described herein (e.g., thickness), it is to be understood that the features, functions and benefits of the innovation can employ characteristics that vary from those described herein. These alternatives are to be included within the scope of the innovation and claims appended hereto.

While, for purposes of simplicity of explanation, the one or more methodologies shown herein, e.g., in the form of a flow chart, are shown and described as a series of acts, it is to be understood and appreciated that the subject innovation is not limited by the order of acts, as some acts may, in accordance with the innovation, occur in a different order and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with the innovation.

To overcome the above mentioned disadvantages and to provide a safe alternative to the traditional helmet, disclosed herein is a protection system comprised of a dome (helmet) portion and a padded upper torso (shoulder/vest) portion that protects the head and neck from injury during a collision by allowing a wearer's head to move freely inside a dome portion (helmet) without contacting an inside of the dome portion in accordance with an aspect of the innovation.

The dome portion has a wide dome-like shape and is configured such that the wearers head will never contact the dome portion even if the wearer bends their neck 90 degrees in any direction. Thus, one advantage of the innovation disclosed herein is that any shock created by collisions does not translate to the wearers' skull and/or neck with any appreciable force, thereby reducing the amount of head and neck injuries encountered using traditional helmets, as mentioned above. Another advantage is that viewing ports may be provided on a top and sides of the dome portion provide the ability to see upward and peripherally. In addition, a large oval cage allows the wearer to easily see left, right, and down. Still yet another advantage of the innovation is that the ergo dynamic configuration facilitates elite athletic performance.

Figure 1:
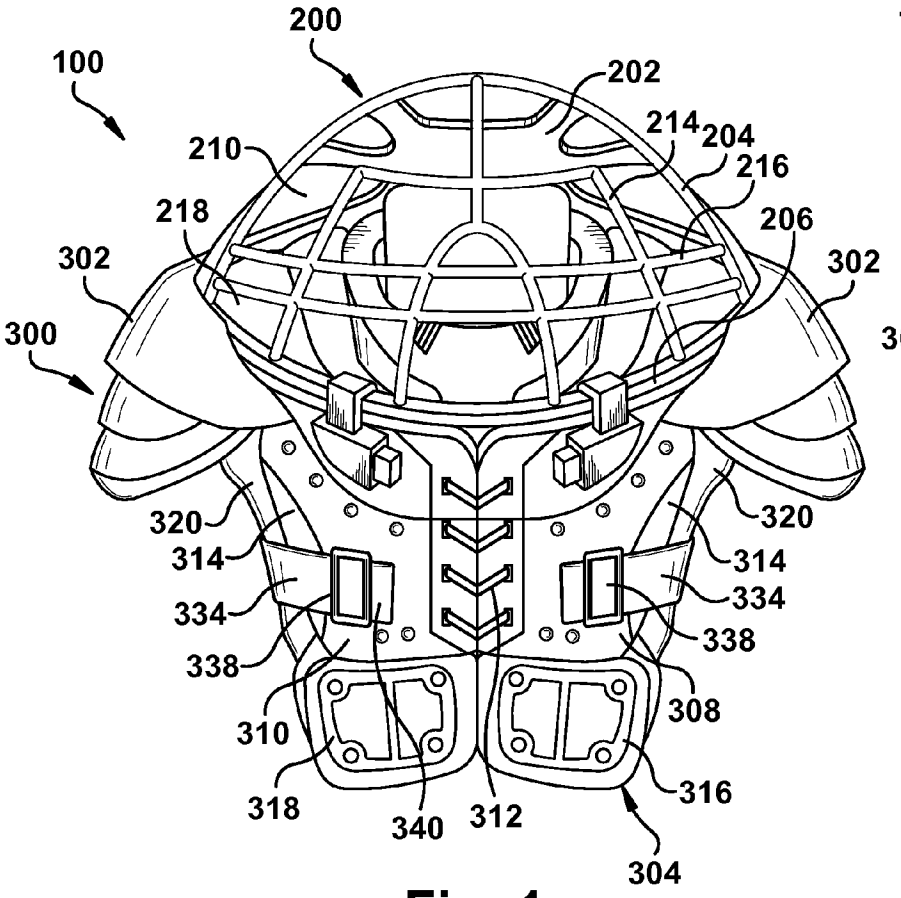
FIG. 1 is a front view of one embodiment of a head and neck protection system in accordance with the innovation.
Figure 3:
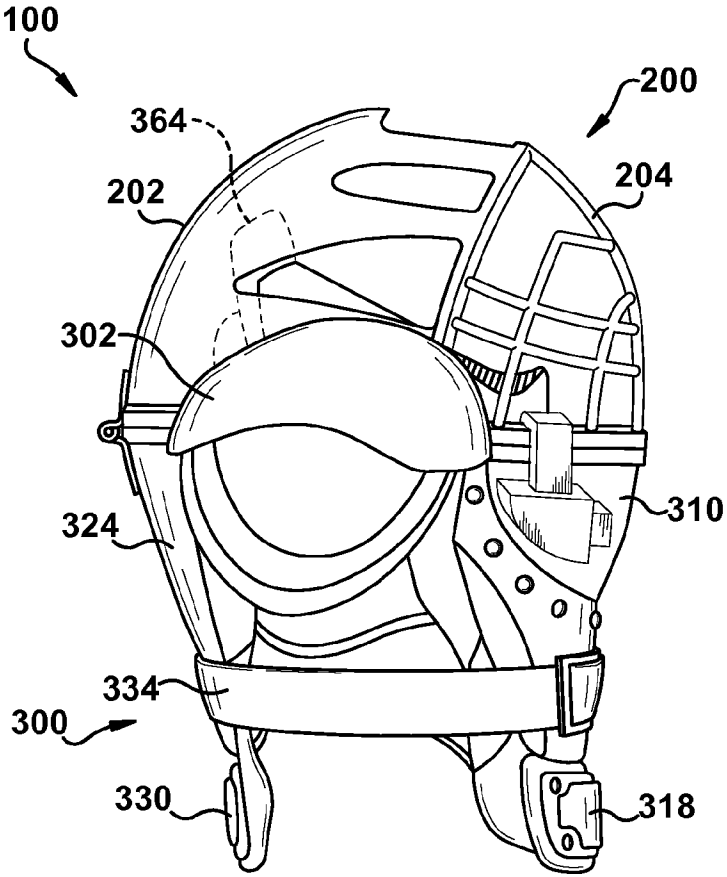
FIG. 3 is a side view of the head and neck protection system in accordance with the innovation.

Referring now the drawings, FIGS. 1-3 are front, rear, and side view illustrations respectively of a head and neck protection system 100 in accordance with an aspect of the innovation. The system 100 includes a dome (helmet) portion 200 and an upper torso (shoulder/vest) padded portion 300.

The dome portion 200 includes a frame 202, a cage 204 attached to a front of the frame 202, and a base ring 206 that extends around a bottom perimeter of the attached frame 202 and cage 204 that increases the integrity of the dome portion 200. The dome portion 200 may be constructed from a material that resists compression, shear, torque, tensile stress, etc. For example, the dome portion 200 may be made from a metal (e.g., titanium, aluminum), from plastic, carbon fiber or other composite material. In one aspect, the frame 202 and cage 204 may be an integrated single unit. In another aspect, the frame 202 and the cage 204 may be detachable from each other and may be connected with fasteners, such as but not limited to hinges, snaps, nuts and bolts, etc.

In addition, in accordance with an aspect of the innovation, the dome portion 200 is configured such that when the wearer's head moves in its full range of motion, the wearer's head does not touch the inside of the dome portion 200 in any direction. In other words, the width, depth, and height of the dome portion 200 must accommodate the full range of motion of the wearer's head. This configuration transmits the force from a collision to the wearer's upper torso and shoulders, thus, bypassing the wearer's skull, brain and neck. As a result, as mentioned above, injuries to the head, brain, neck, and spine are greatly reduced. Padding may be fitted to a top of the dome portion 200 to facilitate in the dissipation of the force.

The frame (rear portion) 202 covers a rear of the wearer's head and, thus, is the part of the dome portion 200 that does not obstruct the wearer's vision. The frame 202 may be opaque or clear and can be painted, stained, or colored to represent traditional colors or logos 208 of various teams or clubs. The frame 202 may include openings 210 for ventilation purposes. In addition, the openings 210 may be fitted with a mesh like material 212 to facilitate the distribution of the force and to protect the wearer from external objects, see FIG. 4.

The cage (front portion) 204 attaches to a front of the frame 202 and provides protection for a front of the player's head. The cage includes multiple intersecting vertical and cross members 214, 216 configured to form a cross-arch design. Viewports 218 are defined between the intersecting vertical and cross members 214, 216 and provide unobstructed sight lines for the full range of movement of the wearer. One or more viewports 218 may also be fitted with the mesh covering 212 shown in FIG. 4 to facilitate the distribution of the force and to protect the wearer from external objects.

The padded shoulder/vest portion 300 includes shoulder pads 302, a front (chest) protector 304, and a rear (back) protector 306. The front and rear protectors 304, 306 are attached to the shoulder pads 302 with a fastening device, such as but not limited to stitching, snaps, buckles, string, etc. The shoulder pads 302 include one or more pads that extend from an area near the neck under the dome portion 200 to an area of the arm between the shoulder and the elbow. In the embodiment illustrated in the figures, the shoulder pads 302 are comprised of multiple pads on each side where each underlying pad extends further down the arm. It is to be understood that the shoulder pads 302 may include any number of pads and, thus, the embodiment illustrated in the figures is for illustrative purposes only and is not intended to limit the scope of the innovation. The shoulder pads 302 are sloped to follow the natural arc of the dome portion 200 and are narrow (essentially no wider than the clavicle) to allow free movement of the wearer's arms above the head.

The front protector 304 includes a chest plate comprised of a first left front plate 308 and a first right front plate 310 coupled together with a fastener 312, such as but not limited to laces, hook and loop, snaps, etc. The first left and right front plates 308, 310 may be made from a strong, yet semi-malleable material, such as but not limited to plastic. In addition, the chest plate 308, 310 may be narrowed to facilitate movement of the wearer's arms in a forward and upward direction. The first left and/or right front plates 308, 310 may include a contour or depression 314 is defined on each side to facilitate the carrying of an object, such as but not limited to a football, close to the body. In the example of carrying a football, the contour 314 is configured to reduce the possibility of the wearer fumbling the football.

The front protector 304 may further include a second left front plate 316 and a second right front plate 318 disposed below the first left and right front plates 308, 310 respectively to provide protection for more of the upper front torso area of the wearer. In addition, padding 320 may be added under the first front plates 308, 310 and under the second front plates 316, 318 to provide additional protection to the wearer's upper front torso. Thus, the padding 320 extends downward from the shoulder pads 302 to provide additional protection to the wearer's front upper torso. The padding 320 may be attached, via stitches, rivets, snaps, etc., to the shoulder pads 302, the first left and right front plates 308, 310, and to the second left and right front plates 316, 318.

The rear protector 306 includes a rear plate comprised of a first left rear plate 322 and a first right rear plate 324 coupled together with a connector portion 326, such as but not limited to elastic material, laces, hook and loop, snaps, etc. The first left and right rear plates 322, 324 may be made from a strong, yet semi-malleable material, such as but not limited to plastic.

The rear protector 306 may further include a second left rear plate 328 and a second right rear plate 330 disposed below the first left and right rear plates 322, 324 respectively to provide protection for more of the upper rear torso area of the wearer. In addition, padding 332 may be added under the first rear plates 322, 324 and under the second rear plates 328, 330 to provide additional protection to the wearer's upper rear torso. Thus, the padding 332 extends downward from the shoulder pads 302 to provide additional protection to the wearer's rear upper torso. The padding 332 may be attached, via stitches, rivets, snaps, etc., to the shoulder pads 302, the first left and right rear plates 322, 324, and to the second left and right rear plates 328, 330.

A pair of straps 334 is provided to connect and tighten the front protector 304 and the rear protector 306. Specifically, each strap 334 is attached, via a bracket 336 with fasteners such as but not limited to rivets, to a lower portion of both the first left and right rear plates 322, 324. Each strap 334 extends around each side of the upper torso of the wearer and attaches to the first left and right front plates 308, 310 respectively and attaches to a tightening device. In one embodiment, the tightening device may include a slidable buckle 338 that can adjust the tension in the strap 334. In another embodiment, each strap 334 is threaded through a slot 340 defined on the front of each first front plate 308, 310 and attaches to a ratcheting tightening device 342 (see FIG. 4A) where the ratcheting tightening device 342 is used to tighten the front protector 304 and the rear protector 306 in accordance with the wearer's upper torso. The ratcheting tightening device 342 includes a lever 344 configured to tighten and loosen the front protector 304 and the rear protector 306 in accordance with the wearer's upper torso.

The padded shoulder/vest portion 300 further includes a channel 346 (see FIG. 4B) disposed around a perimeter defined by the shoulder pads 302, the front (chest) protector 304, and the rear (back) protector 306. The channel 346 is defined inside a frame of the padded shoulder/vest portion 300 and is configured to distribute the force into the padded shoulder/vest portion 300 and away from the head and neck area. Specifically, the base ring 206 described above, resides in the channel 346. Thus, a force due to an impact to the dome portion 200 is transmitted to the padded shoulder/vest portion 300 via the dome portion 200, the base ring 206, and the channel 346.

Figure 6:
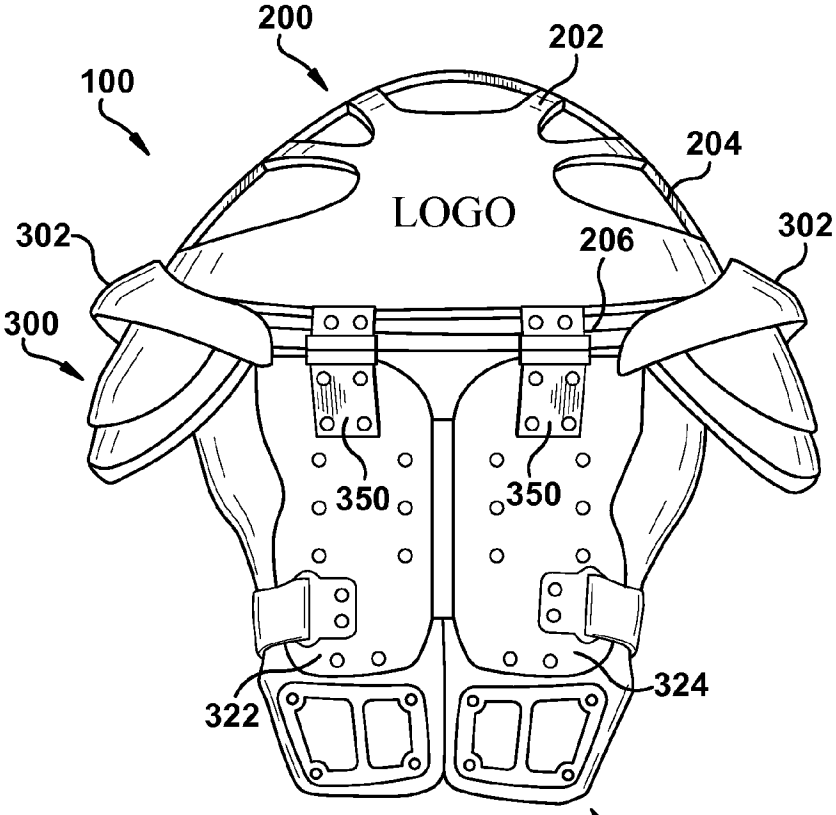
FIG. 6 is the same view as FIG. 2 repeated for simplicity in accordance with the innovation.
Figure 5:
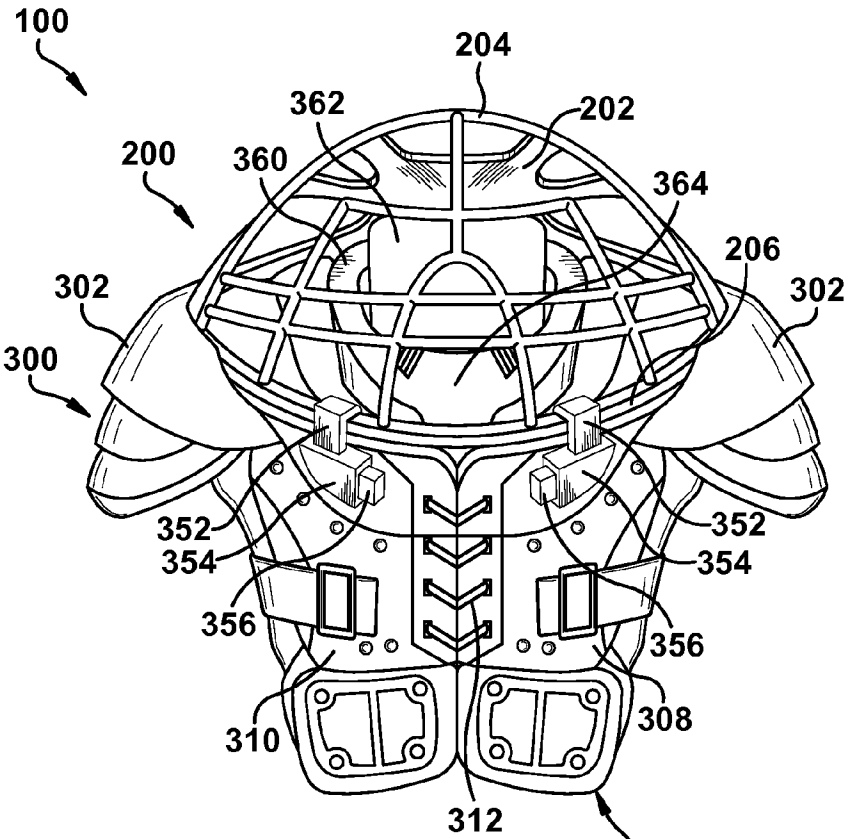
FIG. 5 is the same view as FIG. 1 repeated for simplicity in accordance with the innovation.

Referring to FIGS. 5 and 6, FIGS. 5 and 6 are duplicates of FIGS. 1 and 2 and for simplicity will be used to describe additional features of the head and neck protection system 100. Fastening devices are disposed on the front and on the rear of the padded shoulder/vest portion 300 to secure the dome portion 200 to the padded shoulder/vest portion 300.

Specifically, referring to FIG. 6, in one embodiment the rear fastening device is hinged fasteners 350 provided on the rear of the head and neck protection system 100 in accordance with an aspect of the innovation. Specifically, one or more hinged fasteners 350 are attached to an upper portion of the first left and right rear plates 322, 324 and to a lower portion of the dome portion 200. The hinged fasteners 350 allow the wearer to pivot the dome portion 200 into an open and closed position. The hinged fasteners 350 may be attached with fasteners, such as but not limited to, rivets, nuts and bolts, etc. It is to be understood that the rear fastening device may not only facilitate pivoting, but may also permit removal of the dome portion from the padded shoulder/vest portion 300. Thus, the embodiment illustrated in FIGS. 5 and 6 is for illustrative purposes only and is not intended to limit the scope of the innovation.

Figure 4:
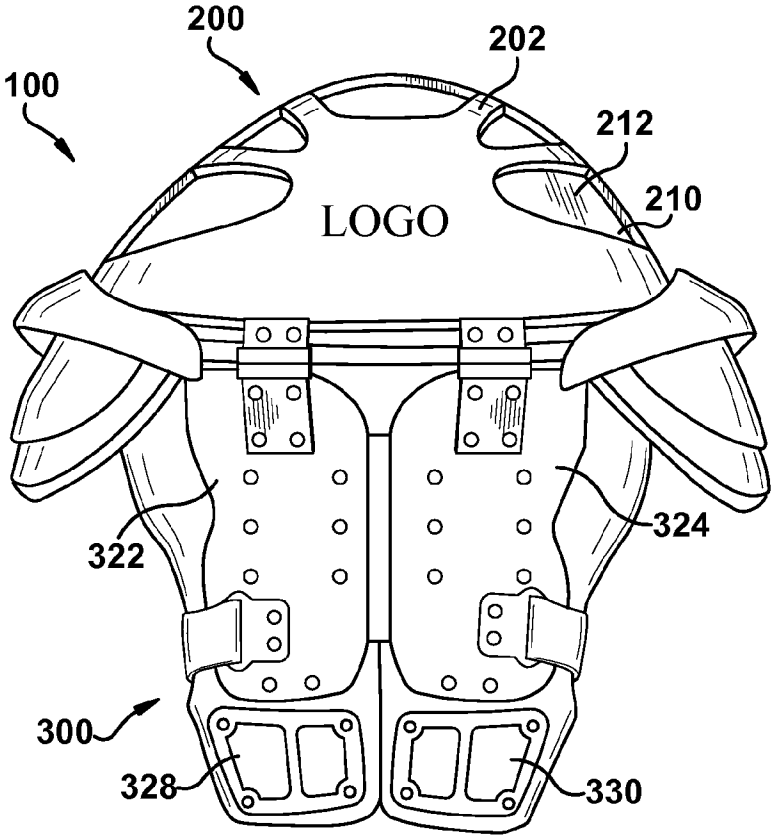
FIG. 4 is a rear view of another embodiment of a head and neck protection system in accordance with the innovation.
Figure 4B:
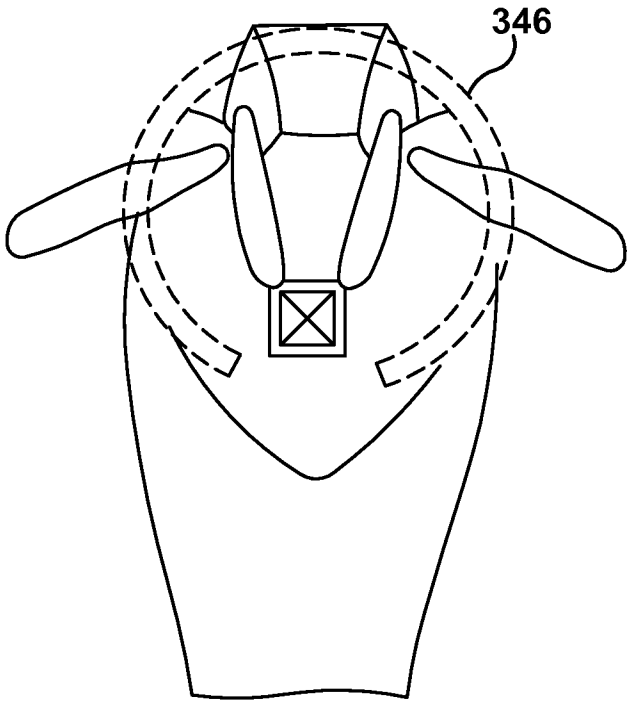
FIG. 4B is a top perspective view illustrating a channel of the head and neck protection system in accordance with the innovation.
Figure 4A:
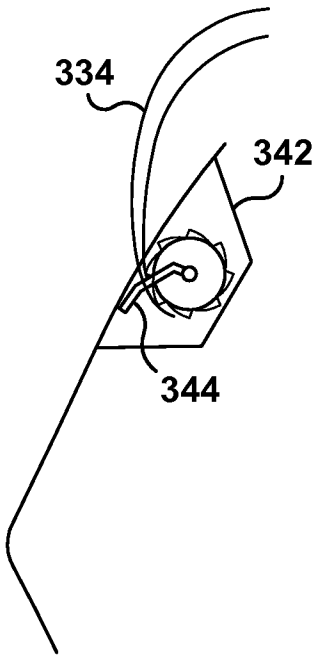

Referring to FIG. 5, the front fastening device includes a front locking assembly disposed on the front of the head and neck protection system 100 to secure the dome portion 200 in a closed position. The front locking assembly includes a latch 352 and a locking component 354 having a release component 356. The latch 352 is attached on a front of the cage 204 and extends down in a U-shaped fashion over both sides of the base ring 206. The locking component 354 is disposed on one or both of an upper portion of the first left and right front plates 308, 310. The locking component 354 receives the latch 352 when the dome portion is in the closed position, as illustrated in FIG. 4. The release component 356 is a spring loaded mechanism that when depressed releases the latch 352 from the locking component 354 to thereby allow the wearer to move the dome portion 200 to the open position. The release component 356 returns to its original position when released.

Still referring to FIG. 5, the head and neck protection system 100 further includes head and neck stabilizers (i.e., padding) comprised of a first stabilizer 360 and a rear stabilizer 362 that provide essentially 360 degrees stability of the head and neck. The first stabilizer 360 surrounds the neck area and extends no farther upward than a jawline of the wearer. The rear stabilizer 362 is disposed behind the head and extends upward behind the head to provide protection against sudden movement injuries (e.g., whiplash) to the neck. The height of the rear stabilizer 362 may vary depending on the wearer's physical make-up and/or preference. Thus, the height of the rear stabilizer 362 may range from zero inches from the top of the wearer's head to approximately flush with the first and second stabilizers 360, 362.

The first and second stabilizers 360, 362 include a base layer, a foam layer and a micro bead layer. The base layer of the first and second stabilizers 360, 362 may be stiff but malleable and angled outward approximately 30-45 degrees for the first stabilizer 360 approximately 65-75 degrees for the rear stabilizer 362. The foam layer covers the base layer and is configured to absorb force. The micro bead layer is disposed on the foam layer and is configured to dissipate force. The first and second stabilizers 360, 362 may be attached, via stitching, riveting, snaps, etc. to an underside of the first left and right front plates 308, 310 and/or the first left and right rear plates 322, 324, and are angled away from the wearer's jaw to lessen impact during collisions and hard falls.

A chin cup or third stabilizer 364 is integrated with the first stabilizer 360 that is approximately 1-2 inches below the chin of the wearer. The chin cup 364 configuration provides a surface upon which to brace for collision and a buffer from persistent jarring to the chin during routine hits and falls.

Figure 7:
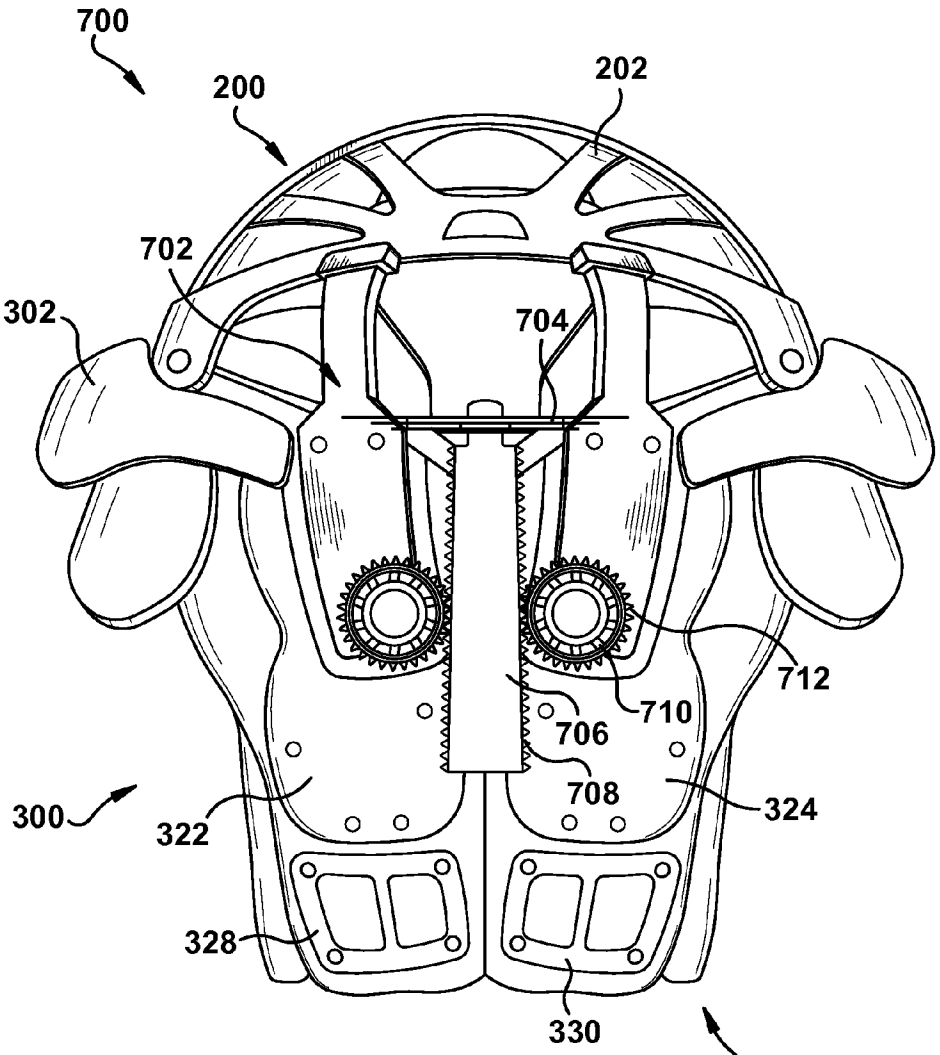
FIG. 7 is a rear view of another embodiment of a head and neck protection system in accordance with the innovation.

FIG. 7 is another embodiment of a head and neck protection system 700 in accordance with an aspect of the innovation. The head and neck protection system 700 in this embodiment is similar to the head and neck protection system 100 described above and, thus, similar features will use the same references numbers as above and will not be repeated.

In this embodiment, the head and neck protection system 700 includes a damper system 702 that serves as a hedge for the forces posed by compression tensile stress, shear, and torque, and also provides another layer of safety. The damper system 702 will deploy when the dome portion 200 is acted upon with a linear force, because the most force that one can exert is when they are moving forward. The damper system 702 will help guarantee that the inertial force will move primarily through the equipment and not to the head and neck of the wearer.

The damper system 702 is disposed inside of a raised yoke located on the rear protector 306 of the head and neck protection system 700 and includes a leaf spring 704, a damper 706 having teeth 708 disposed on each longitudinal side, and a pair of flywheels 710 having cogs 712. The leaf spring 704 is attached to a bottom of the frame 202 of the dome portion 200. The damper 706 attaches to a bottom of the leaf spring 702 and extends downward along the upper rear torso of the wearer. The flywheels 710 are disposed on either side of the damper 706 such that the teeth 708 engage the cogs 712 on both flywheels 710.

When a crown of the dome portion 200 is hit with sufficient force the leaf spring 702 flexes and causes the damper 706 to travel in a downward direction. As the damper 706 moves down, the cogs 712 on the flywheels 710 initially rotate rapidly, but are slowed by the flywheels 710. The flywheels 710 continue to turn slowly, thus, dissipating the force of the original impact. The leaf spring 702 and hence, the damper 706 quickly return the dome portion 200 and cogs 712 to their original position, ready for the next impact.

A padded space frame may be disposed in the front of the head and neck protection system 100, 700 to accommodate the aforementioned mechanisms and to provide added strength and protection for the wearer's sternum.

Figure 8:
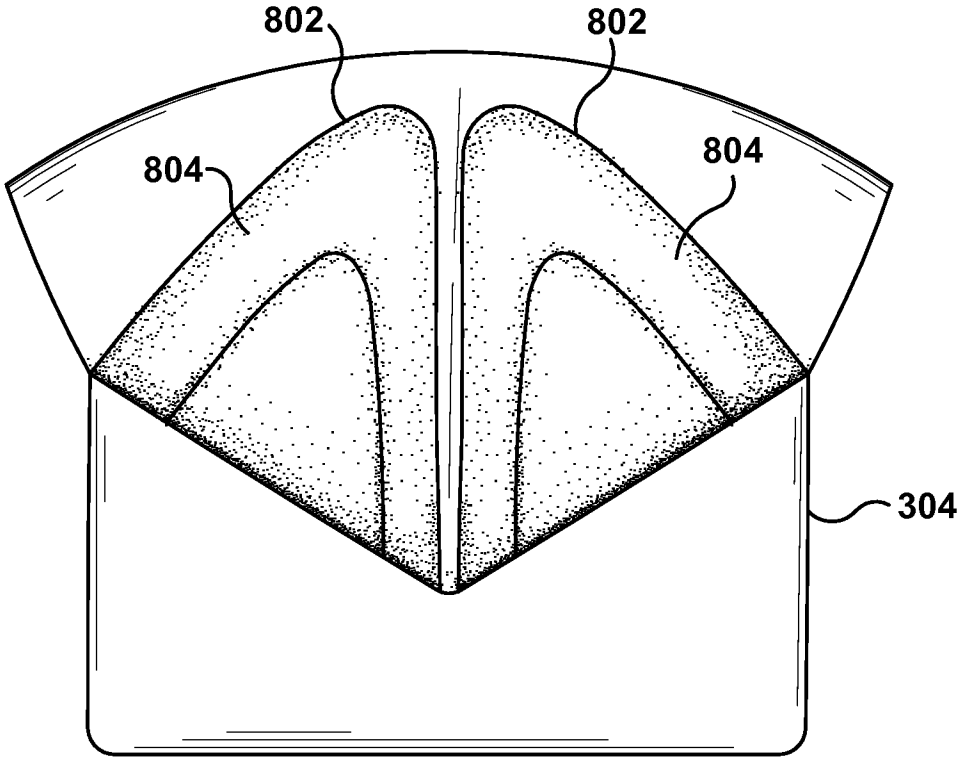
FIG. 8 is a front view of another embodiment of a head and neck protection system in accordance with the innovation.

FIG. 8 is an illustration of another embodiment of a head and neck protection system in accordance with an aspect of the innovation. FIG. 8 illustrates the addition of viewing ports 802 incorporated into the front protector 306 of the head and neck protection system. The viewing ports 802 provide the wearer to glance downward without obstruction. For example, the viewing ports 802 provide a quarterback an opportunity to glance at a pass rusher who may be scrambling at his feet, or for an engaged lineman to spot a potential danger to his knees during a chop block, or for a leaping receiver to see where and how to land after a reception (not to mention fumbles or a puck at their feet).

The viewing ports 802 may be concave to accommodate the contour 314 described above. The viewing ports 802 may include a mesh like material 804 that is nonabrasive, flexible, see through, and breathable. The mesh like material 804 will also provide more ventilation and an avenue for perspiration to escape.

What has been described above includes examples of the innovation. It is, of course, not possible to describe every conceivable combination of components or methodologies for purposes of describing the subject innovation, but one of ordinary skill in the art may recognize that many further combinations and permutations of the innovation are possible. Accordingly, the innovation is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A head and neck protection system comprising:

a dome portion including a rear frame and a cage having a plurality of viewports attached to a front of the rear frame;

a base ring formed around a bottom perimeter of the rear frame and cage;

an upper torso padded portion removably attached to the base ring; and a front locking device that includes a U-shaped latch that extends over a top of the base ring through one of the plurality of viewports and downward over both sides of the base ring thereby engaging a locking device disposed on an upper portion of a chest plate when the dome portion is in a closed position, wherein the dome portion is configured such that a when a wearer's head moves in its full range of motion, the wearer's head does not touch the inside of the dome portion in any direction such that a force from a collision is transmitted to the wearer's upper torso, thereby bypassing the wearer's head and neck.

2. The head and neck protection system of claim 1, wherein the upper torso padded portion includes shoulder pads, a front protector attached to a front of the shoulder pads, and a rear protector attached to a rear of the shoulder pads.

3. The head and neck protection system of claim 2, wherein the front protector includes a front padding extending downward from the shoulder pads to protect the wearer's upper torso and a front chest plate attached to a front of the front padding.

4. The head and neck protection system of claim 2, wherein the rear protector includes a rear padding extending downward from the shoulder pads to protect a back of the wearer's upper torso and a rear plate attached to a front of the rear padding.

5. The head and neck protection system of claim 2 further comprising a pair of straps that attach to a lower portion of the rear plate, wherein each strap extends around opposite sides of the wearer's upper torso and attaches to a tightening device attached to the front protector that facilitates a tightening of the front protector and the rear protector in accordance with the wearer's upper torso.

6. The head and neck protection system of claim 5, wherein the tightening device is a ratcheting device, wherein each strap is inserted through a slot defined in the front protector and engages the ratcheting device, wherein the wearer rotates a handle on the ratcheting device to tighten the pair of straps thereby tightening the front protector and the rear protector in accordance with the wearer's upper torso.

7. The head and neck protection system of claim 1 further comprising a hinged rear fastening device attached to a rear upper portion of the upper torso padded portion that pivotally attaches a rear of the dome portion to a rear of the upper torso padded portion.

8. The head and neck protection system of claim 7, wherein the front locking device further includes a release mechanism that releases the U-shaped latch from the locking device when depressed.

9. The head and neck protection system of claim 1 further comprising a first stabilizer that surrounds the neck area, a second stabilizer disposed behind the wearer's head that extends upward to approximately the center of gravity of the head, and a third stabilizer disposed below a chin of the wearer.

10. A helmet and shoulder/vest system comprising:

a rear frame;

a cage attached to a front of the rear frame and having a plurality of viewports defined between intersecting vertical members and cross members, wherein the rear frame and the cage form the helmet;

shoulder pads;

a front protector attached to a front of the shoulder pads;

a rear protector attached to a rear of the shoulder pads;

a channel defined inside a top perimeter defined by the attachment of the shoulder pads, the front protector, and the rear protector;

a base ring formed around a bottom perimeter of the rear frame and cage that engages the channel such that a force from a collision is transmitted through the helmet and through the channel and to the shoulder pads, front protector, and rear protector, thereby bypassing the wearer's head and neck; and a front locking device that includes a U-shaped latch that extends over a top of the base ring through one of the plurality of viewports and downward over both sides of the base ring thereby engaging a locking device disposed on an upper portion of the front protector when the dome portion is in a closed position.

11. The helmet and shoulder/vest system of claim 10, wherein the rear frame and cage are configured such that a when a wearer's head moves in its full range of motion, the wearer's head does not touch the inside of the rear frame or the cage in any direction.

12. The helmet and shoulder/vest system of claim 10, wherein the front protector includes a first left front plate, a second left front plate disposed below the first left front plate, a left padding attached to the first and second left front plates such that the left padding contacts the wearer's front left side upper torso area, a first right front plate, a second right front plate disposed below the first right front plate, and a right padding attached to the first and second right front plates such that the right padding contacts the wearer's front right side upper torso area.

13. The helmet and shoulder/vest system of claim 10, wherein the rear protector includes a first left rear plate, a second left rear plate disposed below the first left rear plate, a left padding attached to the first and second left rear plates such that the left padding contacts the wearer's rear left side upper torso area, a first right rear plate, a second right rear plate disposed below the first right rear plate, and a right padding attached to the first and second right rear plates such that the right padding contacts the wearer's rear right side upper torso area.

14. The helmet and shoulder/vest system of claim 10, wherein at least one viewport is fitted with a mesh like material.

* * * * *